US011982284B2

(12) United States Patent
Malki et al.

(10) Patent No.: US 11,982,284 B2
(45) Date of Patent: May 14, 2024

(54) OPTIMIZING THE PERFORMANCE OF ELECTRICAL SUBMERSIBLE PUMPS (ESP) IN REAL TIME

(71) Applicant: SAUDI ARABIAN OIL COMPANY, Dhahran (SA)

(72) Inventors: Said S. Malki, Dhahran (SA); Muhammad Daanyal, Ras Tanura (SA); Obiomalotaoso L. Isichei, Dhahran (SA); Hassan A. Hussain, Al Hasa (SA); Razan M. Alzamanan, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 59 days.

(21) Appl. No.: 17/709,042

(22) Filed: Mar. 30, 2022

(65) Prior Publication Data

US 2023/0313807 A1 Oct. 5, 2023

(51) Int. Cl.

| | |
|---|---|
| ***F04D 27/00*** | (2006.01) |
| ***E21B 43/12*** | (2006.01) |
| ***E21B 47/008*** | (2012.01) |
| ***F04D 13/08*** | (2006.01) |

(52) U.S. Cl.

CPC ..... *F04D 27/001* (2013.01); *E21B 43/128* (2013.01); *E21B 47/008* (2020.05); *F04D 13/086* (2013.01); *F04D 27/003* (2013.01); *E21B 2200/20* (2020.05)

(58) Field of Classification Search

CPC .... F04D 27/001; F04D 13/086; F04D 27/003; E21B 43/128; E21B 47/008; E21B 2200/20; E21B 2200/22; E21B 43/12; E21B 47/06; E21B 43/121; E21B 49/087; F04B 49/065; F04B 17/03; F04B 51/00; F04B 47/06; F04B 47/00; F04B 49/20

See application file for complete search history.

(56) References Cited

U.S. PATENT DOCUMENTS

| | | | | |
|---|---|---|---|---|
| 9,638,031 | B2 * | 5/2017 | Li | E21B 47/117 |
| 11,414,967 | B2 * | 8/2022 | Janger | E21B 43/128 |
| 11,519,259 | B2 * | 12/2022 | Bangor | G01H 1/00 |

(Continued)

FOREIGN PATENT DOCUMENTS

| | | | |
|---|---|---|---|
| CA | 3004558 | A1 * | 11/2019 |
| CN | 1970991 | A | 5/2007 |
| DE | 102015000373 | A1 * | 7/2016 |

*Primary Examiner* — Dominick L Plakkoottam

(74) *Attorney, Agent, or Firm* — Osha Bergman Watanabe & Burton LLP

(57) ABSTRACT

A system and method for controlling an electrical submersible pump (ESP) of a well, including a processor and a non-transitory computer-readable medium storing instructions that when executed by the processor cause the processor to perform operations. The operations include obtaining a well model corresponding to the well, obtaining a target well rate for the well, then receiving, from one or more data sources associated with one or more components of the well, operational data associated with the ESP operating at the target well rate within the well, determining a target efficiency of the ESP at the target well rate based on the well model, and then modifying, based on the operational data and the target efficiency an operating characteristic of the ESP.

18 Claims, 6 Drawing Sheets

(56) References Cited

U.S. PATENT DOCUMENTS

| | | | | |
|---|---|---|---|---|
| 2011/0088484 | A1* | 4/2011 | Camilleri | G01F 1/34 73/861.42 |
| 2013/0175030 | A1* | 7/2013 | Ige | G05B 15/02 700/282 |
| 2015/0226062 | A1* | 8/2015 | Machado | E21B 43/12 73/152.29 |
| 2017/0122094 | A1* | 5/2017 | Chugunov | F04D 15/0077 |
| 2017/0175516 | A1 | 6/2017 | Eslinger | |
| 2017/0363088 | A1 | 12/2017 | Nguyen et al. | |
| 2018/0119534 | A1 | 5/2018 | Jamison et al. | |
| 2019/0063193 | A1 | 2/2019 | Pavlov et al. | |
| 2019/0122416 | A1 | 4/2019 | Otta et al. | |
| 2019/0345797 | A1* | 11/2019 | Babic | E21B 47/008 |
| 2020/0088795 | A1 | 3/2020 | Kassab | |
| 2020/0208509 | A1* | 7/2020 | Chen | F04D 25/0686 |
| 2020/0249649 | A1* | 8/2020 | Zhu | G06F 16/9038 |
| 2020/0325766 | A1 | 10/2020 | Gupta et al. | |
| 2021/0071508 | A1* | 3/2021 | Beck | F04B 23/021 |
| 2021/0071509 | A1* | 3/2021 | Beck | F04B 49/065 |
| 2021/0140290 | A1 | 5/2021 | Eslinger et al. | |
| 2022/0003059 | A1* | 1/2022 | Mu | E21B 43/26 |
| 2022/0414299 | A1* | 12/2022 | Benzvi | G06N 20/20 |

* cited by examiner

OPTIMIZING THE PERFORMANCE OF ELECTRICAL SUBMERSIBLE PUMPS (ESP) IN REAL TIME

BACKGROUND

The disclosure relates generally to production of fluid from subterranean reservoirs. More particularly, the disclosure relates to use of an electric submersible pump (ESP) for fluid production, and systems and methods for operating the ESP.

Fluids are typically produced from a reservoir in a subterranean formation by drilling a wellbore into the subterranean formation, establishing a flow path between the reservoir and the wellbore, and conveying the fluids from the reservoir through the wellbore to a destination such as to the surface of the earth, to a bed of a body of water such as a lakebed or a seabed, or to a surface of a body of water such as a swamp, a lake, or an ocean (hereafter "surface.") Fluids produced from a hydrocarbon reservoir may include natural gas, oil, and water. Typically, a production tubing is disposed in the wellbore to carry the fluids to the surface. In some formations, pressure within the rock formation causes the resources to flow naturally from the formation to the surface. One common challenge in producing fluids from a hydrocarbon reservoir through a wellbore is that, in some formations, the pressure in the formation is not adequate to cause the flow against gravity out of the formation to the surface or is not adequate to cause the flow to meet flowrate goals. In such instances, artificial lift technology can be used to add energy to fluid to bring the resources to the surface.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to a system for controlling an electrical submersible pump (ESP) of a well, including a processor and a non-transitory computer-readable medium storing instructions that when executed by the processor cause the processor to perform operations. The operations include obtaining a well model corresponding to the well, obtaining a target well rate for the well, then receiving, from one or more data sources associated with one or more components of the well, operational data associated with the ESP operating at the target well rate within the well, determining a target efficiency of the ESP at the target well rate based on the well model, and then modifying, based on the operational data and the target efficiency an operating characteristic of the ESP.

In another aspect, embodiments disclosed herein relate to a method for controlling an electrical submersible pump (ESP) of a well, the method including obtaining a well model corresponding to the well, obtaining a target well rate for the well, receiving, from one or more data sources associated with one or more components of the well, operational data associated with the ESP operating at the target well rate within the well, determining a target efficiency of the ESP at the target well rate based on the well model; and then modifying, based on the operational data and the target efficiency, an operating characteristic of the ESP.

Other aspects and advantages of the claimed subject matter will be apparent from the following description and the appended claims.

DETAILED DESCRIPTION

Figure 1:
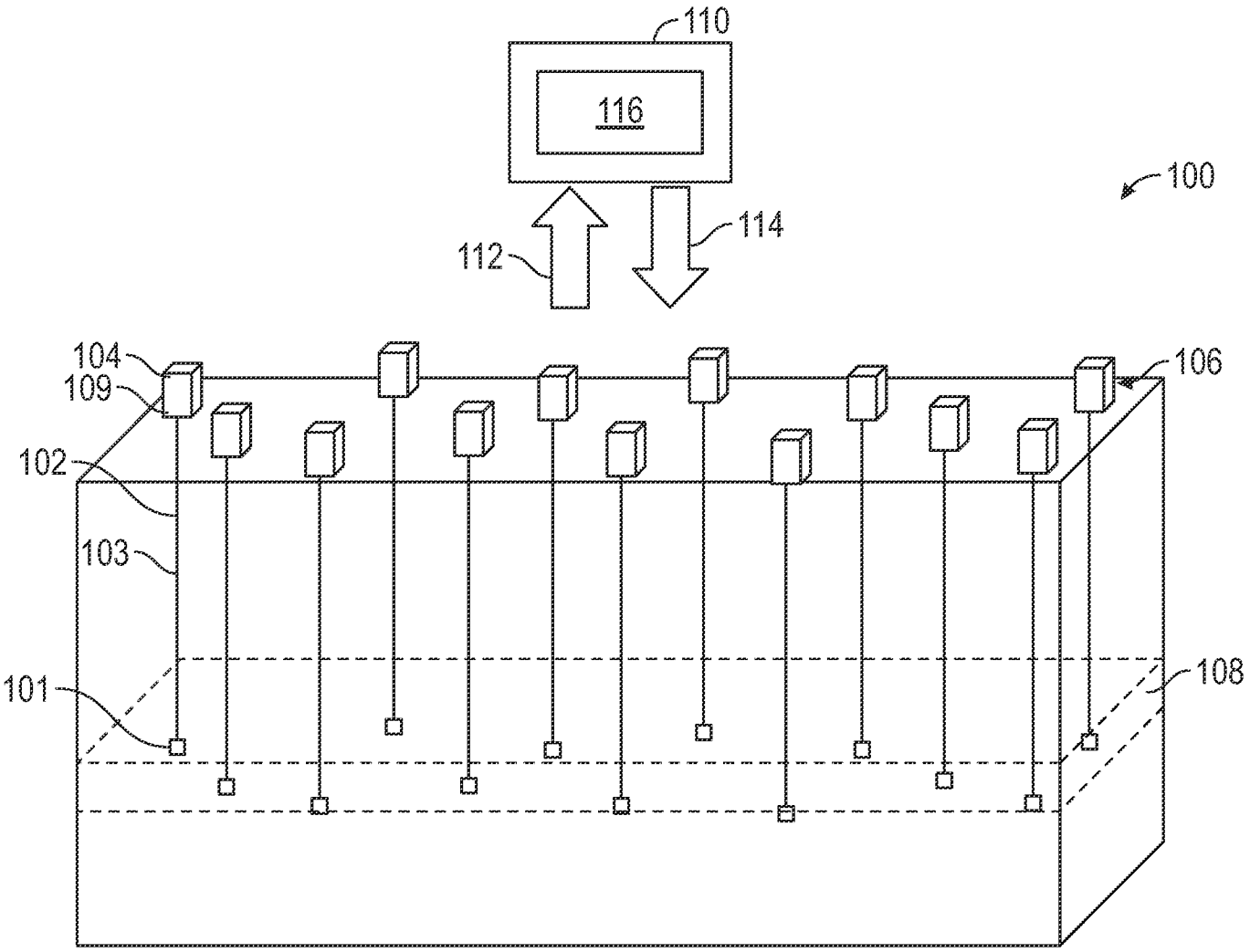
FIG. 1 shows an illustrative wellsite in accordance with one or more embodiments.

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

Regarding the figures described herein, when using the term "down" the direction is toward or at the bottom of a respective figure and "up" is toward or at the top of the respective figure. "Up" and "down" are oriented relative to a local vertical direction. However, in the oil and gas industry, one or more activities take place in a vertical, substantially vertical, deviated, substantially horizontal, or horizontal well. Therefore, one or more figures may represent an activity in deviated or horizontal wellbore configuration. "Uphole" may refer to objects, units, or processes that are positioned relatively closer to the surface entry in a wellbore than another. "Downhole" may refer to objects, units, or processes that are positioned relatively farther from the surface entry in a wellbore than another. True vertical depth is the vertical distance from a point in the well at a location of interest to a reference point on the surface.

For bringing liquids out of a subterranean wellbore to the surface of the Earth, various techniques such as artificial lift technology may be used. Artificial lift technology may include, for example, a pump and associated components to assist in lifting the fluids up the wellbore. As an example, production tubing associated with the wellbore may include one or more pumps to assist in lifting the fluids up the wellbore. The pump may be electrically operated and located submerged in the fluid at or near the bottom of the well. The pump system may use a surface or seabed power source to drive the submerged pump assembly. Alternatively, power for the pump may be provided at another location downhole in the well, such as a downhole fuel cell. These pump systems so configured are termed electric submersible pump (ESP) systems.

Notably, ESP performance may be impacted by various reservoir characteristics such as, for example, gas-oil ratio, water cut, flowing wellhead pressure (FWHP), well test liquid rate, and pump operating frequency. It is beneficial to be able to adjust parameters to optimize ESP performance. In particular, there exists a need for a method for optimizing the performance of electrical submersible pumps (ESP) in real time by recommending the optimum pump control settings to maximize pump operating efficiency and minimize overall power consumption for a determined target well rate.

As such, embodiments disclosed herein present systems and methods that may be used to predict ESP performance, recommend adjustments to parameters, monitor ESP performance after adjustments to parameters, and thereby optimize performance of ESPs in real time. In accordance with some embodiments, an automated process is described that is capable of automatically optimizing the performance of Electrical Submersible Pumps (ESPs) by integrating real-time data, calibrated well models and advanced engineering logics to quickly recommend pump frequency and surface choke settings to adjust a flowing wellhead pressure (FWHP) required to maximize an ESP's efficiency and minimize overall power consumption while complying with reservoir management recommended target production rate for each well. By implementing a digital twin model of an ESP system, optimization of the ESP system may be achieved rapidly and efficiently for a selected target well output rate, a selected flowing wellhead pressure, among other operational parameters. Digital twin, as used herein, shall be understood to be a computer-implemented, virtual model designed to accurately reflect characteristics and operation of a physical, real-world object such as a well or an ESP or both.

The systems and methods, in accordance with embodiments of the disclosure, are therefore configured to determine optimum pump frequency and surface choke settings to obtain a determined production rate using operational data of an ESP operating within a well. The determination also may use a well model digitally representing the well in which the ESP is operating. For example, systems and methods of the present disclosure may involve mapping of data from one or more resources (e.g., sensors associated with an ESP system, operational databases, document databases, etc.) into a well model (e.g., provided by commercially available software such as, for example, PROSPER™ and/or PIPESIM™), in order to obtain current or optimal recommended operational characteristics for an ESP system.

FIG. 1 depicts an illustrative field (100) in accordance with one or more embodiments. The field (100) is a geographical region or location that includes a plurality of wells (102). The field (100) may include the surface equipment of the wells, such as production trees (104), and other production equipment such as pipelines, tanks, separators, etc., configured to gather and/or transport the produced fluids (109). Each well (102) has a wellbore (103) that extends from a surface (106) location into a reservoir (108). The field (100) is delineated by the wells (102) that are near to each other geographically and drilled into the same or different reservoirs (108).

The reservoir (108) is a formation containing fluids intended to be produced such as oil, gas, and/or water. The wells (102) shown in FIG. 1 are vertical conventional wells. However, those skilled in the art will appreciate that the wells in the field (100) may have any wellbore trajectory such as, for example, horizontal, without departing from the scope of this disclosure.

The field (100) of FIG. 1 is shown having thirteen wells (102) each with a production tree (104). Importantly, the number of wells of the field (100) is not intended to be limiting, and the field (100) may have any number of wells (102) without departing from the scope of this disclosure. By applying the systems and methods of the present disclosure to a field including a plurality of wells, even greater economies may be obtained.

According to some embodiments, the wells (102) may be oil wells intended to bring liquid-phase hydrocarbons out of the reservoir (108), known in the art as an oil field. An oil well may have associated gasses such as hydrocarbon gas, hydrogen sulfide gas, and carbon dioxide gas either in gaseous form, dissolved in the carrier liquid, or in liquid form. Thus an "oil well" may be, for example, any well that produces one barrel or more of crude petroleum oil for each 100,000 cubic feet of natural gas. The ratio of gas to oil is the gas-oil ratio (GOR.) The ratio of produced gas volume to total produced liquids (oil and water) volume is the gas-liquid ratio (GLR.) The ratio of gas volume fraction of the total volume of fluids is the gas volume fraction (GVF.) For example, an ESP may be used in an oil well with the GOR in the range of 80-500 scf/bbl (standard cubic feet per barrel), whereas the GLR may only be 20-30 scf/bbl. Those skilled in the art will appreciate that oil wells may have associated gas and other liquids such as condensate, oil, and/or water, and that gas wells may have associated oil and other liquids. The term "free gas" refers to the gaseous phase present in a reservoir or other area. ESPs utilized in oil wells with free gas may utilize accessories known in the art as gas handling devices such as centrifugal devices for oil wells with a GVF of, for example, 45%. Other gas handling devices may accommodate a GVF of up to 75%. While embodiments of the disclosure have been described with respect to a limited number of embodiments, those skilled in the art, having benefit of this disclosure, will appreciate that other embodiments can be devised which do not depart from the present disclosure, the true scope of which being defined by the appended claims.

Figure 2:
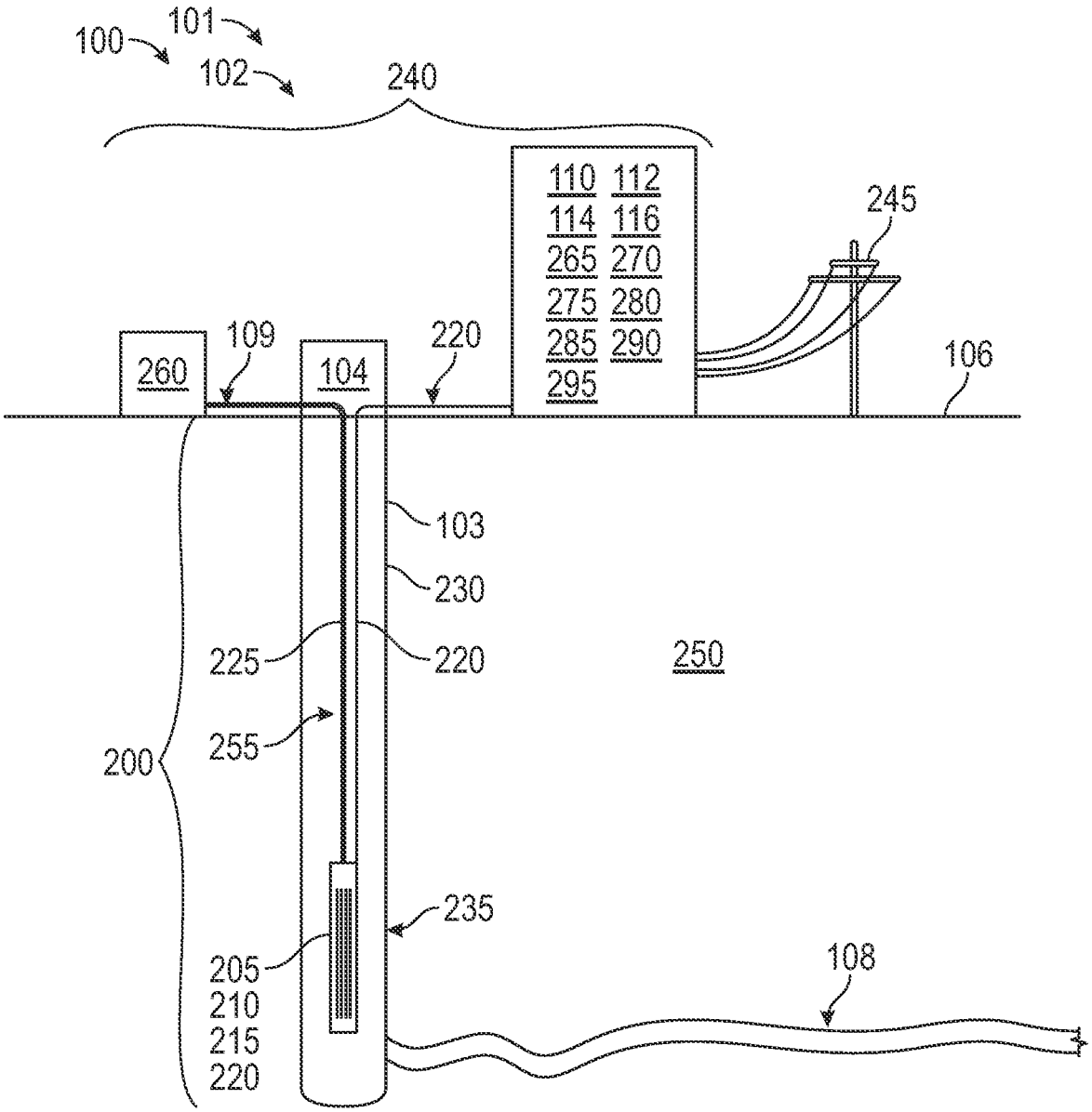
FIG. 2 shows an illustrative electrical submersible pump (ESP) system according to some embodiments of the disclosure.

FIG. 2 highlights a single illustrative well (102) of the field (100). The well (102) includes completion equipment, such as piping and an illustrative ESP system (101).

With respect to ESP systems, an ESP system (101) may include hardware and software with functionality for bringing fluid from a subterranean position at or near a wellbore (103) to the surface at one or more predetermined pressures and/or at one or more predetermined flow rates (e.g., a target well rate).

Perforations (235) in a casing (230) of the well (102) provide a conduit for the produced fluids (109) to enter the well (102) from the reservoir (108) of a formation (250). Thus, the ESP system (101) includes a surface portion having surface equipment (240) and a downhole portion having an ESP string (200).

The ESP string (200) is deployed in the well (102) on production tubing (225) and the surface equipment (240) is located on the surface (106). The production tubing (225) extends to the surface (106) and provides a conduit for produced fluids (109) to migrate to the surface (106). Notably, while the ESP string (200) may be described as a standard ESP string (200), the term ESP string (200) may refer to a standard ESP string (200) or an inverted ESP string (200) without departing from the scope of the disclosure herein. The ESP string (200) may further refer to an ESP disposed in a caisson without departing from the scope of the disclosure herein.

The ESP string (200) thus includes equipment such as a pump (205) and a motor (215) configured to be placed downhole and to provide lift to the fluids located downhole in a reservoir (108) of the formation (250), which enter the well via the perforations (235), to bring the produced fluid (109) to the surface. The ESP system (101) shown at FIG. 2 is intended as illustrative and is not intended to limit the scope of the present disclosure to the configuration shown. Such an ESP system (101) may have an ESP string (200) that may include a motor (215) and a pump (205) with a plurality of stages configured to operate together to generate lift for bringing the produced fluid (109) to the surface. One example of such an ESP is the P31 model pump by Centrilift™, this ESP including 65 pump stages. This example is not intended to be limiting.

A plurality of ESPs may be deployed within the same well (102). For example, each may be operable at a desired speed that may differ across the plurality of ESPs. Thus, a well may be formed with one or more vertical sections and horizontal sections and may include one or more ESPs in each of the vertical sections and horizontal sections without departing from the scope of the disclosure herein. In such cases where a plurality of ESPs has been deployed, systems and methods of the present disclosure may thus be applied to each of installed ESP of the plurality of ESPs.

A pump intake (210) for each pump (205) may be located below the pump (205) in the well (102) and may be placed based on the formation (250), pressure, estimated height of produced fluids (109) in an annulus (255), and optimization of pump (205) performance.

The ESP system (101) being configured to lift the produced fluids (109) arriving at the pump intake (210) of the pump (205) to the surface (106) at a desired FWHP and target well rate may include a plurality of pump (205) stages that are stacked upon one another. Any suitable number of stages may be provided, and the number of stages may be determined prior to installation based on, for example, an estimated, desired discharge pressure, a produced fluid viscosity, a desired flowrate, etc. Each pump (205) stage may include a rotating impeller and a stationary diffuser. As the produced fluids (109) enter each stage, the produced fluids (109) pass through the rotating impeller to be centrifuged radially outward gaining energy in the form of velocity. Pressure is generated as the produced fluids (109) enter the diffuser based on conversion of fluid velocity. As the produced fluids (109) pass through each stage, the pressure continually increases until the produced fluids (109) obtain the designated discharge pressure and have sufficient energy to flow to the surface (106) via the production tubing (225) and through the wellhead equipment (e.g., a surface choke), where the FWHP and well rate can be determined.

Once the produced fluids (109) reach the surface (106), the produced fluids (109) flow through the production tree (104) into production equipment such as surface equipment (240). The surface equipment (240) may include a choke (260) configured to control the flowrate and, thereby, the FWHP of produced fluids (109). The choke (260) may comprise any suitable device for changing a diameter of an orifice, such as, for example, an adjustable choke. According to embodiments of the present disclosure the choke (260) may have a powered adjustment such as an electric, hydraulic, or pneumatic actuator. The powered adjustment may be controlled by the ESP system (101) such as, for example, via an electrical signal sent to the actuator. The signal may, for example, operate a pilot valve or electric relay to provide power to the actuator of the choke (260) thereby enabling manipulation and adjustment of the choke (260).

The ESP string (200) pump (205) is configured to operate with a particular efficiency based on various operational parameters of the pump (205) and characteristics of the well (102). For example, the operational parameters may include head, power, flowrate, FWHP, and other parameters. The operational parameters may depend, at least in part, on a motor (215) of the ESP string (200) operatively connected to the pump (205) of the ESP string (200). The motor (215) is configured to provide rotational energy to the pump (205). Flowrate controls (e.g., a choke such as the choke (260)) are configured to adjust a flowrate of the fluids externally from the pump (205) itself.

The motor (215) is operatively linked to the pump (205) and a power source (245). The motor (215) may include a downhole submersible motor (215) configured to provide rotational power to the pump (205). The motor (215) may be, for example, a two-pole, three-phase, squirrel-cage induction electric motor (215), a permanent magnet electric motor, or other type of motor.

The operating voltages, currents, frequencies, and horsepower ratings of the motor (215) may change depending on operational parameters of the ESP system (101) installation and may further be varied by one or more control interfaces provided by the motor. Thus, FWHP, and thereby, efficiency of the ESP system (101), may be modified by changing one or more operational parameters of the ESP system (101) (e.g., an operational frequency, a choke setting, etc.), The size of the motor (215) may be determined by the amount of power estimated for the pump (205) to provide lifting force for an estimated, desired volume of produced fluids (109) from the bottom of the well (102) to the surface (106). The motor (215) may be cooled by the produced fluids (109) passing over the motor (215) housing. The motor (215) is powered by a power source (245). The power source (245) may be any suitable power source capable of providing a desired level of power to the motor such that the motor can run the ESP at desired levels. For example, the power source (245) may include a commercial power distribution system and/or a portable power source such as a generator. The power source (245) may further include an electrically conductive cable (220) that is capable of transferring power (and, e.g., information) from another source uphole to the motor. The power source (245) may be configured to transfer energy from the surface equipment (240) to the motor (215) at a particular level (e.g., voltage, current, frequency, etc.) according to one or more instructions received from a controller.

The sensors may be configured to provide operational data corresponding to operational parameters of the ESP string (200) within the well (102). For example, the sensors may be configured to provide actual pressure data (e.g., FWHP) for the ESP operating at a particular frequency with a particular surface choke setting, and other operational parameters.

The ESP system (101) also includes various surface equipment (240) such as an electric drive (265) and ESP control equipment (270). The ESP control equipment (270) may include controllers and electric drives to maintain the desired supply of electricity to the motor (215) and to cause the ESP string (200) to function within desired operational parameters (e.g., power consumption, frequency, etc.) The ESP control equipment (270) may further comprise devices such as, for example, switchboards, soft-start controllers, and variable speed controllers.

To control operational parameters such as an operating speed of the ESP, an electric drive such as a variable speed drive (VSD) fed by an alternating current (AC) supply may be employed. The VSD may be configured to synthesize three-phase AC voltages and currents of a desired frequency to power the ESP such that the ESP operates in the desired manner.

The VSD and a source of the AC supply can be disposed on the surface (e.g., outside the well) and the three-phase AC power may be delivered into the well to the ESP through a cable (220) that extends from the surface (106) to a location inside the well where the ESP is deployed.

In addition, an ESP system (101) may include a controller (275) that includes hardware and/or software for obtaining information related to the ESP system and adjusting one or more operational characteristics of the ESP system (e.g., flow rate, surface choke, operational frequency, etc.) in response to a command from an optimization manager (280) or other directing entity. For example, an ESP system (101) may include one or more communication interfaces (e.g., communication interface (285)) and/or memory (290) for transmitting and/or obtaining operational data via a well network.

The ESP system (101) may include one or more sensors (295) operatively coupled to the controller (275) for conveying data corresponding to characteristics of components of the ESP system (101) as well as operational data of the ESP system to the controller (275). For example, the data may include alternating current frequency, power consumption, temperature, intake pressure, output pressure, and FWHP. To that end, such sensors may include pressure sensors, rotational velocity sensors, ammeters, voltmeters, etc. The sensor data may be recorded on computer-readable storage media by the controller (275) and/or transmitted by the controller to one or more monitoring entities within the well network.

One or more computer-readable media associated with the controller (275) may also include computer-executable instructions (a program) configured to collect, store, parse, and analyze the operational data of the ESP system. The program may be configured to perform operations consistent with embodiments of the present disclosure, for example, determine current state variables of the ESP system (101), adjust various operating characteristics based on determined values, etc. The program may further arithmetically calculate revised state variables that seek output state goals, such as for example, mathematically seeking maximum and/or minimum values associated with variables of the ESP system in response to feedback from a workflow in cooperation with systems and methods of the present disclosure. As noted above, while an ESP system (101) may correspond to a single pump (205), in some embodiments, an ESP system (101) may correspond to multiple pumps (205).

A computer system (110) may be provided at a location on the surface (106) and may be connected to the one or more controllers (275) present in the field (100) by any suitable connection technique, such as, for example, wireless (Wi-Fi, cellular, Bluetooth, etc.) or wired (Ethernet, serial cable, etc.)

The computer system (110) may be configured to receive a plurality of data inputs (112) associated with each well (102) in the field (100) The inputs may include, for example, operational data corresponding to a well structure (e.g., depth, pressure, etc.), sensor data obtained from one or more sensors (e.g., sensors associated with the ESP system (101)) associated with equipment for each well (102), modeling parameters associated with the well, and flow characteristic of the well. The inputs may be configured to produce a plurality of outputs (114) based on the plurality of inputs (112) using a computer processor (116).

The computer system (110) may be configured to execute and/or maintain one or more auxiliary systems for enabling functionality of the present disclosure. For example, the computer system (110) may include a database for storage and retrieval of data, corresponding to, for example, inputs, outputs, models, etc. used to implement the systems and methods of the disclosure. Any suitable database may be implemented (e.g., file system, relational database management system (RDBMS) etc.) without departing from the scope of the present disclosure.

According to some embodiments, the computer system (110) may be configured to provide control information based on the plurality of outputs. For example, the computer system may be configured to provide a control signal to the surface choke (260) to cause the surface choke (260) to change a diameter associated with the surface choke (260) (e.g., to modify the surface choke) when target (e.g., optimization) outputs indicate a desired change in surface choke (e.g., for modifying FWHP.) Further, the computer system (110) may be configured to provide a command to a pump controller associated with an ESP system (101) to cause a change in operating frequency of the ESP system (101) when target (e.g., optimization) outputs indicate a desired change in operating frequency. These commands are illustrative only, and any such control commands are intended to fall within the scope of the present disclosure. The computer system (110) and the computer processor (116) are further explained below in FIG. 5.

The inputs (112) may include any type of data gathered from and/or associated with the wells (102) or any data known about the well (102) of the reservoir (108) such as a well model of the well, flow rate, fluid composition, produced liquid rate, equipment data, reservoir data, downtime factors, etc. The outputs (114) may include ESP efficiency and ESP power consumption, actual produced liquid rate, target produced liquid rate (hereafter "target well rate"), target well model, target ESP efficiency, target ESP power consumption, etc. The target well rate may be chosen to be less than a maximum well rate. In a field (100) such as the one depicted in FIG. 1, in each well (102) an ESP system (101) consumes power while providing pressure to fluids throughout the life of the ESP.

Figure 3:
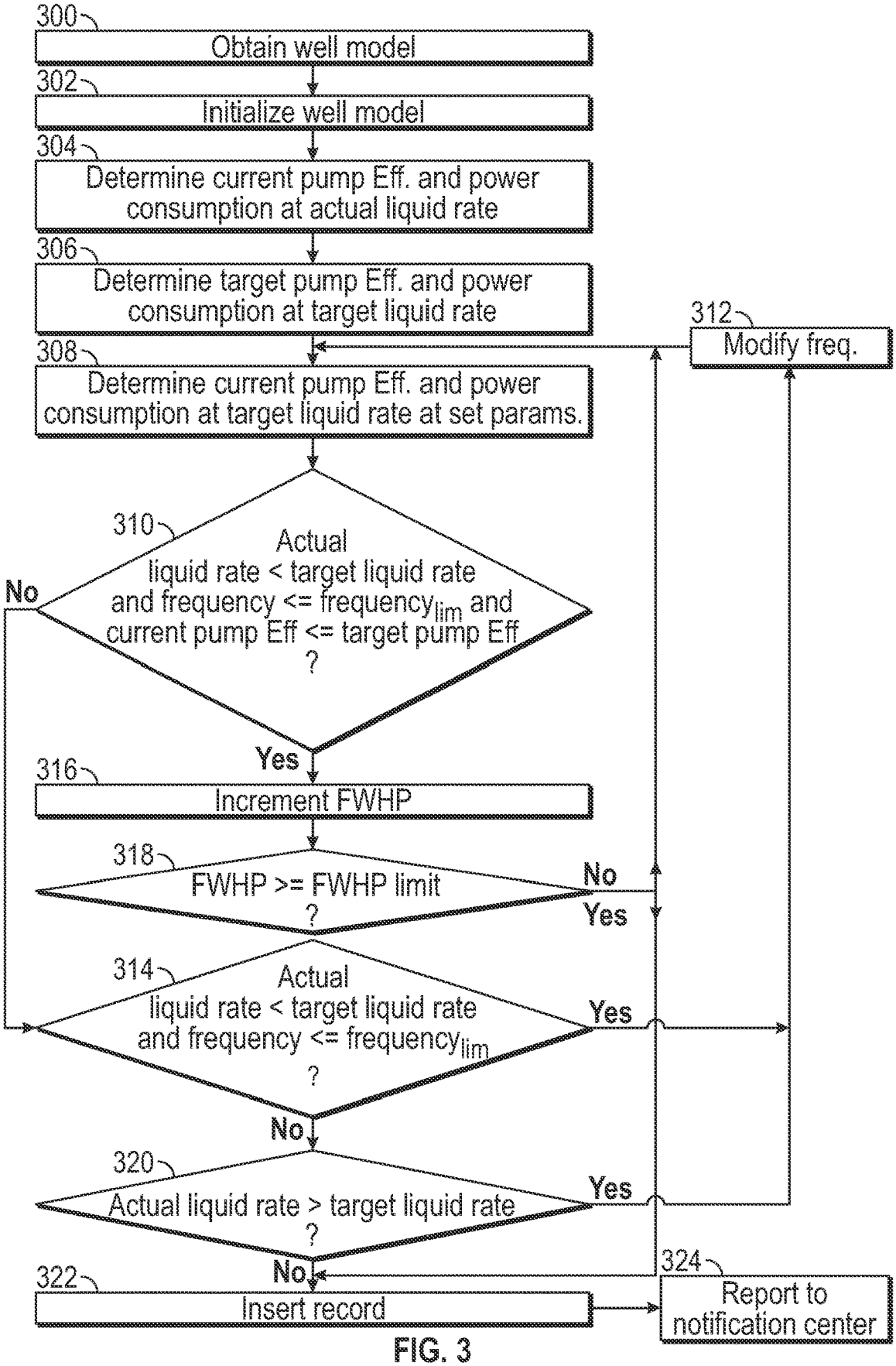
FIG. 3 shows a flowchart highlighting an illustrative method according to embodiments of the disclosure.

FIG. 3 depicts a flowchart illustrating a method for operating an electrical submersible pump (ESP) system according to one or more embodiments of the disclosure.

Specifically, FIG. 3 illustrates a method, according to embodiments of the disclosure, for improving production performance of a well (102) using ESP operational data obtained from one or more ESPs in the field (100) of wells (102) where each well (102) includes at least one ESP system (101). Computer instructions for causing a processor to carry out the method outlined in FIG. 3 may be stored on a non-transitory computer readable medium for execution by the computer system (110). Further, one or more blocks in FIG. 3 may be performed by one or more components as described with respect to FIGS. 1 and 2. While the various blocks in FIG. 3 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

Initially, a workflow may be prepared that includes a well list including one or more wells that are to be processed within this workflow. For example, a workflow may be prepared based on a determined well processing order where wells may be sorted based on, for example, a latest measurement of a discharge pressure (DP) ratio:

$$DP\ \text{Ratio} = \frac{DP\ \text{Choke}}{DP\ ESP} = \frac{(FWHP - \text{Downstream Pressure})}{(\text{Pump Discharge Pressure} - \text{Pump Intake Pressure})}$$

As the ratio increases, the likelihood of energy waste also increases from undue choking with higher frequency operation to meet a target rate. Therefore, wells having a higher ratio relative to other wells can be prioritized (i.e., placed earlier in the workflow) to enable processing earlier on. By prioritizing such wells for processing, the energy waste can be reduced earlier on thereby resulting in greater impact and higher value.

A well to be processed is selected from the well list of the workflow and a well model of the well (e.g., a digital twin) is obtained (300) using, for example, a computer processor (116) and a library of suitable starting well models. Operational data of the ESP system (101) may comprise one or more of the inputs (112) for determining a well model from which to begin for the ESP system (101). Operational data of the ESP system may correspond to, for example, data for the reservoir (108) into which the well (102) is drilled and in which the ESP system (101) is installed. The data for the reservoir (108) may be limited to static reservoir pressure and well productivity index for building a well Inflow Performance Relationship (IPR) model. The data may be obtained via interactive coupling with reservoir simulation modeling packages to capture the impact of other reservoir attributes including porosity, permeability, fluid make up, area of the reservoir (108), height of pay zone, formation volume factor, etc. As explained above, the performance factors may be selected from a list including, for example, flow rate, fluid composition, produced liquid rate, equipment data, and reservoir data.

A suitable starting well model may be a latest validated well model where one or more of liquid rate and productivity index (PI) have been validated. For example, when validating liquid rate, a well model may be considered valid if the difference between a predicted and measured liquid rate is within approximately 5%. Additionally, when validating PI, a well model may be considered valid when the performed date of the PI test is later than any well workover date for the associated well. As used herein, the term "workover" is intended to refer to a procedure undertaken that is intended to increase production but is not part of the routine maintenance of a well and associated equipment.

In the situation where more than one valid well test is available, the most recent valid well test may be selected to define a latest valid well test. A model using a latest valid well test may thus be considered a "latest validated well model." In the situation where no valid well model is available, a technician may be notified to enable examination of the implemented data, well model, etc., to determine a course of action such as selecting a different well from the well list of one or more wells that are to be processed within this workflow.

A modelling application provided by, for example, a commercially available program executed by the computer processor (116) may be used for storage, retrieval, and execution of one or more models. Commercially available programs available as of the priority date of this patent application include, for example, reservoir simulation modeling packages Petrel™, PIPESIM™, and PROSPER™. This list is not intended to be limiting, nor are the determinations intended to be limited to the commercially available program. Any suitable software (e.g., custom-coded applications) providing similar functionality to that described may also be implemented without departing from the scope of the present disclosure.

According to some embodiments, the selected well model may be initialized (302) with actual operational data associated with the ESP system (101). For example, actual operational data (real time data) may be obtained from the one or more sensors (295) associated with the ESP system (101) and/or well test data obtained during initial completion of the well (102). The actual operational data may comprise, for example, gas-to-oil ratio (hereafter GOR), water cut (hereafter WC), FWHP, downstream pressure, well test liquid rate, and pump operating frequency, pump intake pressure, pump discharge pressure. Data inputs to the model may include, for example:

- Well data such as casing or liner size, weight, grade; tubing size, weight, grade type and thread, plus condition; pump setting depth (measured depth and vertical depth); perforated or openhole interval; and well plug-back total depth (measured and vertical),
- Production data such as wellhead tubing pressure; wellhead casing pressure; present production rate; producing fluid level and/or pump-intake pressure at datum point; static fluid level and/or static bottomhole pressure at datum point; datum point; bottomhole temperature; desired target production rate; GOR; and water cut,
- Well-fluid conditions such as specific gravity of water; oil API or specific gravity; specific gravity of gas; bubble-point pressure of gas; viscosity of oil (dead); and other available pressure/volume/temperature (PVT) data,
- Power sources such as available primary voltage, frequency, and power source capabilities, and
- Possible production problems such as sand, scale deposition, corrosion, paraffin/asphaltenes, emulsion, gas, and high reservoir temperature.

ESP efficiency and ESP power consumption may be determined using ESP operational data, reservoir data, and other data, via the computer processor (116) execution of the selected model by the computer processor (116). Operational data, reservoir data, and other data may include data from categories such as PVT (pressure, volume, temperature) test reports, deviation surveys, wellbore devices, pump, motor, and cable specification data, well PI (productivity index) test data, reservoir pressure data, and monthly rate test data.

An initial hybrid well model calculation may be performed to determine a current pump efficiency and a current pump power consumption using the computer processor (116) (304), based on ESP operational data received, from the one or more sensors (295). For example, the current pump efficiency and the current pump power consumption may be determined by running the pump efficiency and pump power consumption calculations of the modelling application.

The hybrid well model calculation then proceeds to determine a target pump efficiency, a target pump frequency, and a target pump power consumption using the computer processor (116) (306) and relevant inputs. For example, for purposes of determining a target pump efficiency, target pump frequency, and target pump power consumption, the actual produced test liquid rate may be replaced by the target production liquid rate, the well test FWHP may be replaced by a surface pressure, and the pump motor operating frequency may be replaced by a pump motor frequency low corresponding to a lowest frequency at which the pump will be run to facilitate the calculation (308). In one or more embodiments the surface pressure may be predetermined and may correspond to, for example, the well test downstream pressure. The pump motor frequency low may also be predetermined and may be, for example, 30 Hz (Hertz).

A comparison is then made between the actual liquid rate and the target liquid rate, between the current pump motor frequency and an incremented pump motor frequency limit, and between the current pump efficiency and a target pump efficiency to determine if: the actual liquid rate is less than the target liquid rate, the current pump motor frequency is less than or equal to the incremented pump motor frequency limit, and the current pump efficiency is less than or equal to the target pump efficiency (310).

In one or more embodiments the incremented pump motor frequency limit may be in a range between the pump motor frequency low (e.g., 30 Hz) up to 100 Hz. For example, the incremented pump motor frequency limit may be predetermined and may be 70 Hz (Hertz).

If any of the following are true: the actual liquid rate is greater than or equal to the target liquid rate; the current pump motor frequency is greater than the incremented pump motor frequency limit; the current pump efficiency is greater than the target pump efficiency (310: no), then the computer processor proceeds to step 314 and compares the actual liquid rate with the target liquid rate and the current frequency with the incremented pump motor frequency limit. If the actual liquid rate is less than the target liquid rate and the current frequency is less than or equal to the incremented pump motor frequency limit (314: yes), then the computer processor increments the pump motor frequency by a desired frequency value corresponding to a frequency increment (312) to define an incremented pump motor frequency.

In one or more embodiments the frequency increment may be in a range between −30 Hz to 70 Hz. For example, the frequency increment may be predetermined and may be equal to ±1 Hz (Hertz). In other words, where adjustment of the pump frequency by the pump frequency increment is intended to increase liquid rate from the pump, then a pump frequency increment may be positive (e.g., 1 Hz). In contrast, where adjustment of the pump frequency by the pump frequency increment is intended to decrease liquid rate from the pump then a pump frequency increment may be negative (e.g., −1 Hz.)

The incremented pump motor frequency may then be input into the hybrid well model calculation and the hybrid well model calculation repeated (308) to determine the current pump efficiency, current pump frequency, and current pump power consumption using the incremented pump motor frequency.

Returning then to step 310, when all of the following are true: the actual liquid rate is less than the target liquid rate; the current pump motor frequency is less than or equal to the incremented pump motor frequency limit; and the current pump efficiency is less than or equal to the target pump efficiency (310: yes) then the computer processor increments the surface pressure by a FWHP increment (316) to define an incremented FWHP.

In one or more embodiments the FWHP increment may be in a range of from 0.1 psi (0.007 bar) to 1000 psi (70 bar). For example, the FWHP increment may be predetermined and may be 10 psi (pounds per square inch pressure) (0.7 bar).

In one or more embodiments the incremented FWHP may be subject to an incremented FWHP limit, corresponding to, for example, a shut-in wellhead pressure (SIWHP) expected for the well. In such embodiments, a comparison may be made between the incremented FWHP and the incremented FWHP limit to determine if the incremented FWHP limit has been reached (318). The situation where the incremented FWHP limit has been reached (318: yes) is discussed in greater detail below.

When the incremented FWHP limit has not been reached (318: no), the incremented FWHP may then be input into the hybrid well model calculation and the hybrid well model calculation repeated (308) to determine the current pump efficiency, current pump frequency, and current power consumption using the incremented FWHP. The conditions of step 310 may then be reevaluated to determine whether to proceed to step 314 or step 316 following the calculations performed at step 308.

Returning to step 314, if the actual liquid rate is greater than or equal to the target liquid rate and/or the current frequency is greater than the frequency limit (314: no) then a comparison is made between the actual liquid rate and the target liquid rate to determine if the actual liquid rate is greater than the target liquid rate (320). If the actual liquid rate is greater than the target liquid rate (320: yes), then the computer processor increments the frequency with a negative increment per step (312) to reduce the actual liquid rate to a level less than or equal to the target liquid rate.

Iteration continues between steps 308 and 320 until either step 320 is reached with an actual liquid rate less than or equal to the target liquid rate (320: no), or step 318 is reached with the incremented FWHP meeting or exceeding the FWHP increment limit (318: yes).

When the actual liquid rate is less than or equal to the target liquid rate (320: no), then it may be assumed that target operating characteristics (e.g., optimum characteristics) for the ESP at the target liquid rate have been determined and a new record indicating the final values may be stored for reference (322) and/or applied to the ESP system. Likewise, when the incremented FWHP meets or exceeds the incremented FWHP limit (318: yes), then it may be assumed that the "final" operating characteristics (e.g., current characteristics) for the ESP at the incremented FWHP limit have been determined and a new record indicating the final values may be stored for reference (322) and/or applied to the ESP system. For example, an operational record may be inserted into an ESP Optimization Table (322), e.g., maintained in the database or other suitable data storage structure of computer system (110).

An illustrative operational record may comprise any data suitable for tracking the operational characteristics of the ESP at the optimized efficiency. For example, the operational record may include the record identification (REC_ID), a pump identifier (EP_A_NUM), the current pump operating frequency (Current_Pum_Operating_Frequency), the current pump operating power (Current_Pum_Operating_Power), the current pump operating efficiency (Current_Pum_Operating_Efficiency), the optimized pump operating frequency (Optimized_Pum_Operating_Frequency), the optimized pump operating power (Optimized_Pum_Operating_Power), the optimized pump operating efficiency (Optimized_Pum_Operating_Efficiency), well model used (WELL_MODEL used), and the well test used (WELL_TEST used).

In addition to storing the operational record, the operational record may be reported, for example, to a notification center and may further be reported by an alert and an advisory (324) to a notification center and/or one or more concerned entities (e.g., a technician), as desired. The report may comprise the optimized pump frequency, the optimized FWHP, the optimized surface choke setting, the expected efficiency improvement, and/or the expected power saving. According to some embodiments, reaching "final" operating characteristics may indicate that a desired optimization was not achieved and that further examination of the system may be desirable. In such a case, a technician may be notified to enable examination of the implemented data, well model, etc., to determine whether erroneous results were obtained. This may allow the technician to run the procedure again with different inputs to obtain a more desirable output and to correct issues for future analyses.

The described process may be carried out for each well of the field, and appropriate values, where available, may be applied from previously determined and stored operational records (e.g., where well models and ESP installations are sufficiently similar.)

According to some embodiments, variations in the process may be made without departing from the scope of the present disclosure. For example, following each iteration of steps 308 to 320, an ESP motor load can be checked to determine whether the motor load has exceeded a predetermined limit, e.g., an operational best-practice limit. According to some embodiments, a best practice may be to operate the motor in the range from 70 to 100% of its manufacturer ratings for motor operating load, motor shaft HP, housing burst pressure, and fluid velocity. Operational best-practice motor operating load limits range from a minimum motor operating load such as 10% to a maximum motor operating load below 110%, where:

$$\text{Motor Operating Load \%} = \left(\frac{\text{operating amperage} \cdot \text{operating voltage}}{\text{nameplate amperage} \cdot \text{nameplate voltage}}\right) \cdot 100$$

When it is determined that motor operating load has reached or exceeded the operational limits, the process may terminate with a notification sent to the notification center to enable confirmation of the model and/or other operational data. Alternatively, or in addition, an operational record including the operational characteristics may be stored along with, for example, a flag indicating that the predetermined limit for motor operating load was reached at the corresponding operational characteristics.

According to some embodiments, once the operational record has been stored and the report sent to the notification center, operational parameters of the ESP system (101), for example, pump frequency and FWHP, may be modified based on commands received from computer system (110) and according to the determined values. The FWHP may be adjusted indirectly by adjusting, for example, a surface choke setting. For example, surface choke may be increased by providing a command to the surface choke device to decrease a diameter of the orifice of the surface choke device or decreased by providing a command to the surface choke device to increase a diameter of the orifice according to the recommended or target FWHP determined through the above-described process.

Figure 4A:
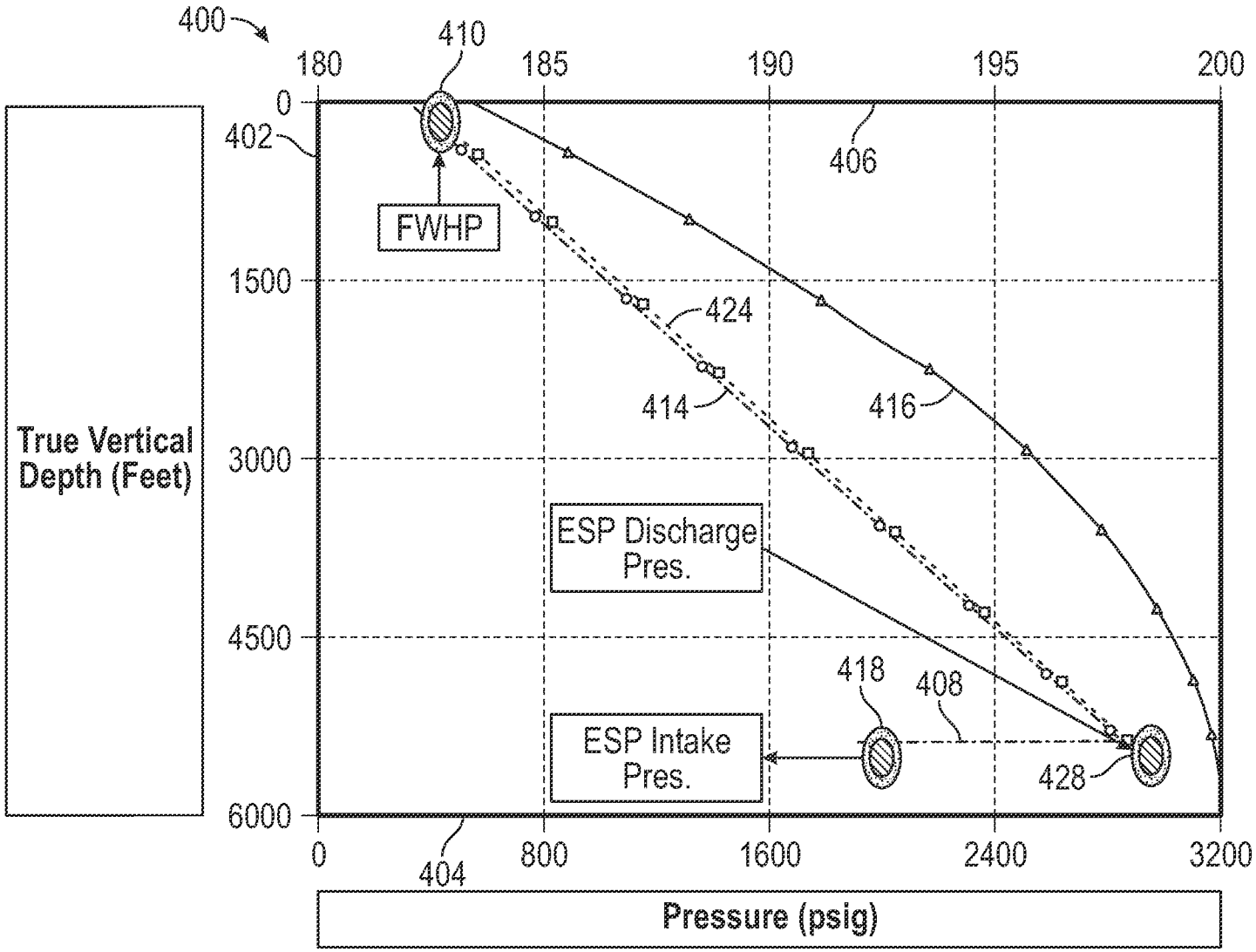
FIGS. 4A and 4B show ESP performance curves according to embodiments of the disclosure.

FIG. 4A illustrates an embodiment of an ESP pressure as a function of depth (400). A true vertical depth (hereafter "TVD") scaled in units of feet is shown on a TVD axis (402) on the left vertical axis and a pressure scaled in units of psi (pounds per square inch) on a pressure axis (404) on the lower horizontal axis and a temperature scaled in units of Fahrenheit on a temperature axis (406) on the upper horizontal axis. A temperature gradient profile line (416) is scaled to the temperature axis (406). A first iterated modeled pressure gradient line (414) shows an ESP pressure gradient profile as determined by the model and scaled to the pressure axis (404). A second iterated modeled pressure gradient line (424) shows an ESP pressure gradient profile as determined by the model and scaled to the pressure axis (404). A pressure build-up (408) between an ESP intake pressure (418) and an ESP discharge pressure (428) is scaled to the pressure axis (404). Point (410) shows a FWHP. Points 410, 418, and 428 correspond to the pressures and temperatures as a function of depth as measured by a sensor on an illustrative well. The lines 414 and 424 illustrate that the pressure-depth gradient as determined by the model matches the actual measured sensor pressure at both the pump intake and discharge depth as well as at surface FWHP. Likewise, line 416 illustrates that the temperature-depth gradient as determined by the model matches the actual measured sensor temperature at both the pump depth as well as at surface.

Figure 4B:
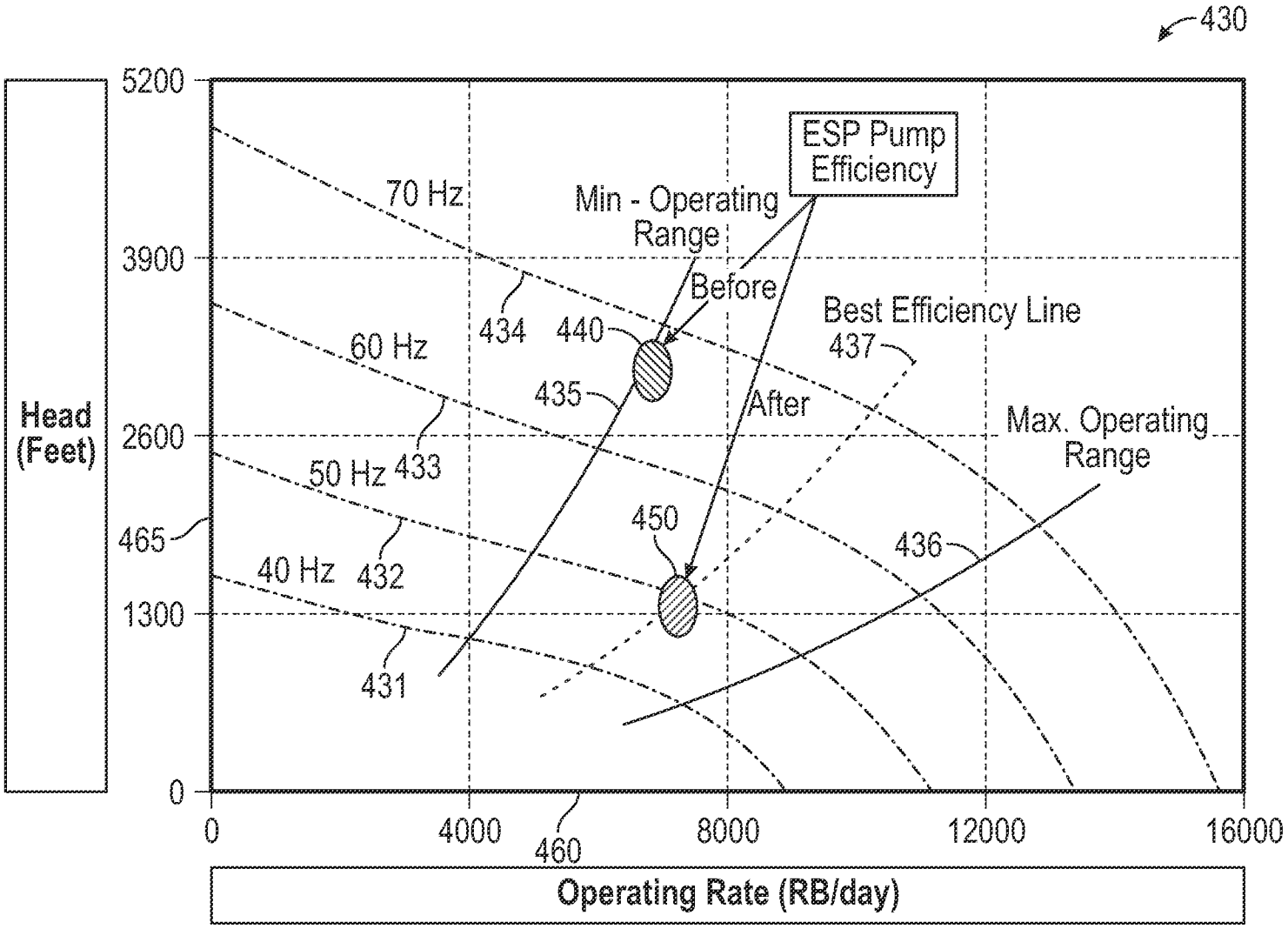

FIG. 4B illustrates an embodiment of an ESP performance curve (430) describing the performance of a pump comprising a graph of lines for seven parameters of the ESP system (101, FIG. 1). The ESP performance curve (430) shows four pump motor input electric-power frequencies (431, 432, 433, 434), two corresponding operating range limits (435, 436), and one ESP BEP (437). The pump may be operated at any one of the frequencies, which are in units of Hertz (Hz). A first operating point (440) is shown at a minimum operating range limit (435) and midway between two operating frequencies (433, 434). A second operating point (450) is shown at the intersection of the ESP BEP (437) and a second operating frequency (432). For each of the seven lines, an operating rate in units of reservoir-conditions barrels per day is shown on an RB per day axis (460) on the bottom horizontal axis and a head in units of feet is shown on a system head axis (465) on the left vertical axis. In accordance with one or more embodiments disclosed herein a recommendation is made to reduce the operating frequency from the first operating point (440) to the second operating point (450), thereby causing a desired increase in efficiency for the target value.

Figure 5:
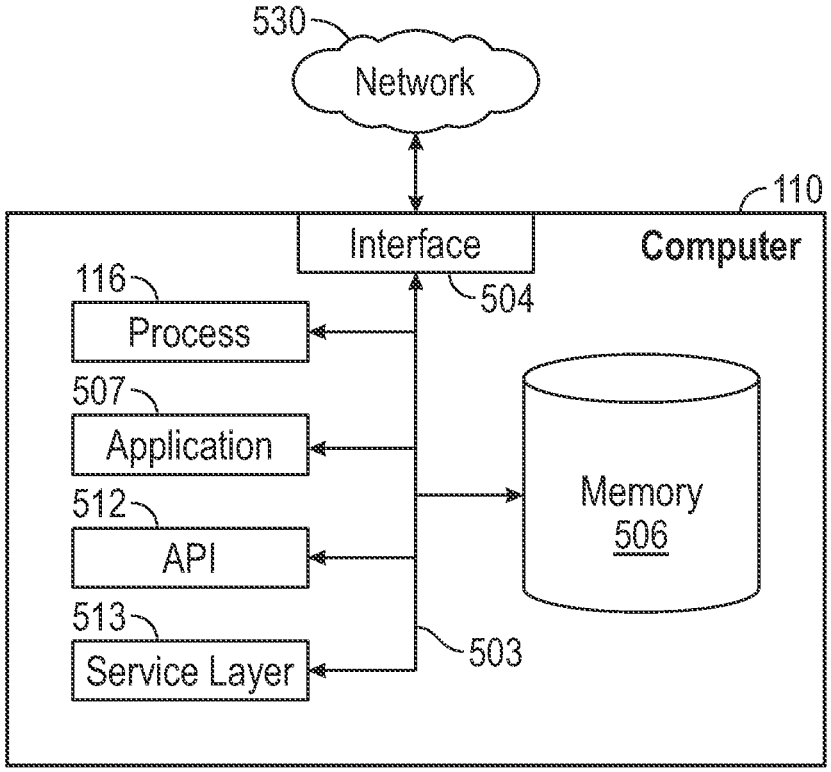
FIG. 5 shows a computer system according to embodiments of the disclosure.

FIG. 5 is a block diagram of a computer (110) used to provide computational functionalities associated with described algorithms, methods, functions, processes, flows, and procedures as described in the instant disclosure, according to an implementation. The illustrated computer (110) is intended to encompass any computing device such as a server, desktop computer, laptop/notebook computer, wireless data port, smart phone, personal data assistant (PDA), tablet computing device, one or more processors within these devices, or any other suitable processing device, including both physical or virtual instances (or both) of the computing device. Additionally, the computer (110) may include a computer that includes an input device, such as a keypad, keyboard, touch screen, or other device that can accept user information, and an output device that conveys information associated with the operation of the computer (110), including digital data, visual, or audio information (or a combination of information), or a graphical user interface (GUI.)

The computer (110) can serve in a role as a client, a network component, a server, a database or other persistency, or any other component (or a combination of roles) of a computer for performing the subject matter described in the instant disclosure. The illustrated computer (110) is communicably coupled with a network (530). In some implementations, one or more components of the computer (110) may be configured to operate within environments, including cloud-computing-based, local, global, or other environment (or a combination of environments).

At a high level, the computer (110) is an electronic computing device operable to receive, transmit, process, store, or manage data and information associated with the described subject matter. According to some implementations, the computer (110) may also include or be communicably coupled with an application server, e-mail server, web server, caching server, streaming data server, business intelligence (BI) server, or other server (or a combination of servers).

The computer (110) can receive requests over network (530) from a client application (for example, executing on another computer (110)) and responding to the received requests by processing the said requests in an appropriate software application. In addition, requests may also be sent to the computer (110) from internal users (for example, from a command console or by other appropriate access method), external or third-parties, other automated applications, as well as any other appropriate entities, individuals, systems, or computers.

Each of the components of the computer (110) can communicate using a system bus (503). In some implementations, any or all of the components of the computer (110), both hardware or software (or a combination of hardware and software), may interface with each other or the interface (504) (or a combination of both) over the system bus (503) using an application programming interface (API) (512) or a service layer (513) (or a combination of the API (512) and service layer (513). The API (512) may include specifications for routines, data structures, and object classes. The API (512) may be either computer-language independent or dependent and refer to a complete interface, a single function, or even a set of APIs. The service layer (513) provides software services to the computer (110) or other components (whether or not illustrated) that are communicably coupled to the computer (110).

The functionality of the computer (110) may be accessible for all service consumers using this service layer. Software services, such as those provided by the service layer (513), provide reusable, defined business functionalities through a defined interface. For example, the interface may be software written in JAVA, C++, or other suitable language providing data in extensible markup language (XML) format or another suitable format. While illustrated as an integrated component of the computer (110), alternative implementations may illustrate the API (512) or the service layer (513) as stand-alone components in relation to other components of the computer (110) or other components (whether or not illustrated) that are communicably coupled to the computer (110). Moreover, any or all parts of the API (512) or the service layer (513) may be implemented as child or sub-modules of another software module, enterprise application, or hardware module without departing from the scope of this disclosure.

The computer (110) includes an interface (504). Although illustrated as a single interface (504) in FIG. 5, two or more interfaces (504) may be used according to particular desires or implementations of the computer (110). The interface (504) is used by the computer (110) for communicating with other systems in a distributed environment that are connected to the network (530). Generally, the interface (504) includes logic encoded in software or hardware (or a combination of software and hardware) and operable to communicate with the network (530). More specifically, the interface (504) may include software supporting one or more communication protocols associated with communications such that the network (530) or interface's hardware is operable to communicate physical signals within and outside of the illustrated computer (110).

The computer (110) includes at least one computer processor (116). Although illustrated as a single computer processor (116) in FIG. 5, two or more processors may be used according to particular desires or particular implementations of the computer (110). Generally, the computer processor (116) executes instructions and manipulates data to perform the operations of the computer (110) and any algorithms, methods, functions, processes, flows, and procedures as described in the instant disclosure.

The computer (110) also includes a memory (506) that holds data for the computer (110) or other components (or a combination of both) that can be connected to the network (530). For example, memory (506) may include a database storing data and/or processing instructions consistent with this disclosure. According to further embodiments, memory (290) may correspond, for example, to memory (506) where a computer 110 has been implemented as a controller for an ESP system (101). Although illustrated as a single memory (506) in FIG. 5, two or more memories may be used according to particular desires and/or implementations of the computer (110) and the described functionality. While memory (506) is illustrated as an integral component of the computer (110), in alternative implementations, memory (506) can be external to the computer (110).

The application (507) is an algorithmic software engine providing functionality according to particular desires and/or particular implementations of the computer (110), particularly with respect to functionality described in this disclosure. For example, application (507) can serve as one or more components, modules, applications, etc. Further, although illustrated as a single application (507), the application (507) may be implemented as multiple applications (507) on the computer (110). In addition, although illustrated as integral to the computer (110), in alternative implementations, the application (507) can be external to the computer (110).

There may be any number of computers (110) associated with, or external to, a computer system containing computer (110), each computer (110) communicating over network (530). Further, the term "client," "user," and other appropriate terminology may be used interchangeably as appropriate without departing from the scope of this disclosure. Moreover, this disclosure contemplates that many users may use one computer (110), or that one user may use multiple computers (110).

While a number of illustrative embodiments have been described in detail above, those skilled in the art will readily appreciate that many modifications are possible in the example embodiments without materially departing from the scope of the present disclosure. For example, according to some embodiments, it may be possible to achieve rapid optimization by utilizing similar operational characteristics for wells determined to be similar to previously optimized wells, such as wells in the same formation, wells with similar fluid properties, and wells with similar pressures and temperature, etc. Additionally, the described process may be carried out at desired intervals for each well in a field of wells. For example, the process may be performed on a predetermined basis, such as daily, weekly, monthly, yearly, etc., and/or following a triggering event, such as, for example, receiving new well test data (e.g., new well rate.) Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112(f) for any limitations of any of the claims herein, except for those in which the claim expressly uses the words 'means for' together with an associated function.

Throughout the description, including the claims, the term "comprising a" should be understood as being synonymous with "comprising at least one" unless otherwise stated. In addition, any range set forth in the description, including the claims should be understood as including its end value(s) unless otherwise stated. Specific values for described elements should be understood to be within accepted manufacturing or industry tolerances known to one of skill in the art, and any use of the terms "substantially" and/or "approximately" and/or "generally" should be understood to mean falling within such accepted tolerances.

Although the present disclosure herein has been described with reference to particular embodiments, it is to be understood that these embodiments are merely illustrative of the principles and applications of the present disclosure.

It is intended that the specification and examples be considered as illustrative only, with a true scope of the disclosure being indicated by the following claims.

What is claimed:

1. A system for controlling an electrical submersible pump (ESP) of a well, the system comprising:

a processor; and a non-transitory computer-readable medium storing instructions that when executed by the processor cause the processor to perform operations comprising:

obtaining a well model corresponding to the well;

obtaining a target well rate for the well;

receiving, from one or more data sources associated with one or more components of the well, operational data associated with the ESP operating at the target well rate within the well;

determining a target efficiency of the ESP at the target well rate based on the well model; and modifying, based on the operational data and the target efficiency an operating characteristic of the ESP;

wherein the modifying comprises one or more of:

controlling a flowing wellhead pressure (FWHP) based on the target efficiency of the ESP; and adjusting an operating frequency of the ESP based on the target well rate and the target efficiency.

2. The system of claim 1, wherein the operations further comprise:

determining an actual operating efficiency of the ESP at the target well rate; and performing the modifying when the actual operating efficiency of the ESP at the target well rate is less than the target efficiency of the ESP at the target well rate.

3. The system of claim 2, wherein the obtaining the well model corresponding to the well comprises:

preparing a workflow including a well list comprising a plurality of wells for processing, wherein the preparing comprises:

assigning a priority to one or more of the plurality of wells in the well list based on a discharge pressure ratio associated with a respective well;

determining a latest valid well test for each unprocessed well not already processed within the workflow; and selecting a well model from the workflow based on a respective latest valid well test and a respective priority.

4. The system of claim 3, wherein the operations comprise:

initializing the selected well model with the operational data.

5. The system of claim 3, wherein the determining an actual operating efficiency of the ESP at the target well rate comprises:

executing a hybrid well model calculation based on the selected well model and the operational data;

determining a target pump frequency;

determining a target pump power consumption; and determining a motor operating load.

6. The system of claim 1, wherein the controlling the FWHP comprises:

adjusting a FWHP control parameter value from a first value to a second value.

7. The system of claim 6, wherein the adjusting the FWHP control parameter value comprises:

adjusting the FWHP control parameter value by a predetermined increment.

8. The system of claim 1, comprising:

modifying a choke to a target choke setting to obtain a target FWHP associated with the target efficiency of the ESP.

9. The system of claim 8, comprising:

storing at least one of the target FWHP and the target efficiency of the ESP as an operational record; and determining an expected efficiency of the ESP using the operational data and the operational record.

10. A method for controlling an electrical submersible pump (ESP) of a well, the method comprising:

obtaining a well model corresponding to the well;

obtaining a target well rate for the well;

receiving, from one or more data sources associated with one or more components of the well, operational data associated with the ESP operating at the target well rate within the well;

determining a target efficiency of the ESP at the target well rate based on the well model; and modifying, based on the operational data and the target efficiency, an operating characteristic of the ESP;

wherein the modifying comprises one or more of:

controlling a flowing wellhead pressure (FWHP) based on the target efficiency of the ESP; and adjusting an operating frequency of the ESP based on the target well rate and the target efficiency.

11. The method of claim 10, comprising:

determining an actual operating efficiency of the ESP at the target well rate; and performing the modifying when the actual operating efficiency of the ESP at the target well rate is less than the target efficiency of the ESP at the target well rate.

12. The method of claim 11 wherein the obtaining the well model corresponding to the well comprises:

preparing a workflow including a well list comprising a plurality of wells for processing, wherein the preparing comprises:

assigning a priority to one or more of the plurality of wells in the well list based on a discharge pressure ratio priority associated with a respective well;

determining a latest valid well test for each unprocessed well not already processed within the workflow; and selecting a well model from the workflow based on a respective latest valid well test and a respective priority.

13. The method of claim 12, comprising:

initializing the selected well model with the operational data.

14. The method of claim 12, wherein the determining an actual operating efficiency of the ESP at the target well rate comprises:

executing a hybrid well model calculation based on the selected well model and the operational data;

determining a target pump frequency;

determining a target pump power consumption; and determining a motor operating load.

15. The method of claim 10, wherein the controlling the FWHP comprises:

adjusting a FWHP control parameter value from a first value to a second value.

16. The method of claim 15, wherein the adjusting the FWHP control parameter value comprises:

adjusting the FWHP control parameter value by a predetermined increment.

17. The method of claim 10, comprising:

modifying a choke to a target choke setting to obtain a target FWHP associated with the target efficiency of the ESP.

18. The method of claim 17, comprising:

storing at least one of the target FWHP and the target efficiency of the ESP as an operational record; and determining an expected efficiency of the ESP using the operational data and the operational record.

* * * * *